US006412780B1

(12) United States Patent
Busch

(10) Patent No.: US 6,412,780 B1
(45) Date of Patent: Jul. 2, 2002

(54) STATISTICALLY ENHANCED SPORT GAME APPARATUS

(76) Inventor: William K. Busch, 530 Arenas St., La Jolla, CA (US) 92037

( * ) Notice: Subject to any disclaimer, the term of this patent is extended or adjusted under 35 U.S.C. 154(b) by 0 days.

(21) Appl. No.: 09/643,243

(22) Filed: Aug. 22, 2000

(51) Int. Cl.[7] ..... A63F 3/00; A63F 7/06

(52) U.S. Cl. ..... 273/292; 463/3; 463/4; 273/237

(58) Field of Search ..... 273/237, 238, 273/244.1, 244.2, 259, 277, 88, 85 R, 139, 298, 244, 93 C, 292; 463/3, 4, 51; 364/410

(56) References Cited

U.S. PATENT DOCUMENTS

| | | | | |
|---|---|---|---|---|
| 4,324,402 A | | 4/1982 | Klose | 273/88 |
| 4,381,864 A | | 5/1983 | Bromley et al. | 273/88 |
| 5,026,058 A | | 6/1991 | Bromley | 273/93 |
| 5,067,079 A | | 11/1991 | Smith, III et al. | 364/410 |
| 5,108,110 A | * | 4/1992 | Nerbas | 273/244 |
| 5,145,173 A | * | 9/1992 | Crowder | 273/93 |
| 5,411,259 A | * | 5/1995 | Pearson et al. | 273/93 |
| 5,472,191 A | | 12/1995 | Hendricks | 273/85 |
| 5,769,714 A | | 6/1998 | Wiener et al. | 463/3 |
| 5,782,470 A | | 7/1998 | Langan | 273/139 |
| 5,888,136 A | | 3/1999 | Herbert | 463/22 |
| 6,012,721 A | * | 1/2000 | Harnish | 273/298 |

* cited by examiner

*Primary Examiner*—Jessica J. Harrison
*Assistant Examiner*—Yveste G Cherubin
(74) *Attorney, Agent, or Firm*—Henri J. A. Charmasson; John D. Buchaca

(57) ABSTRACT

A table game provides for realistic simulation of known athletes' performance in the context of a virtual game predicated upon the career statistics of those athletes, uses card carrying along one of their edges, space-proportioned zones representing the percentage of occurrence of each possible outcome of a player's move during that player's career. A random number generator drives a display of a series of individually selectable points or locations that are matched to one of the zones in order to determine the outcome of a virtual move. The game is particularly adapted to the simulation of baseball, cricket, basketball, or golf competitions.

16 Claims, 2 Drawing Sheets

STATISTICALLY ENHANCED SPORT GAME APPARATUS

FIELD OF THE INVENTION

This invention relates to electronically enhanced board games, and more particularly, to sport games practiced by professional players such as baseball, cricket, basketball, or golf where statistical data on the careers of past and contemporary sport figures can be used to influence the outcome of each move initiated by a game user.

BACKGROUND OF THE INVENTION

The prior art offers several examples of electronic board games which attempt to simulate the documented performance of certain athletes in the context of a virtual game as disclosed in U.S. Pat. No. 5,026,058 Bromley and U.S. Pat. No. 5,067,079 Smith, III et al. In those two examples, the input and processing of the statistical data are achieved by means of programmable microprocessor. A multiplicity of game control options are offered to the user requiring a very complex and eventually costly apparatus. In the above-listed examples as well as in some simpler types of board games, the statistical data are combined with the output of a random number or random event device as well as with the parameters and action choices selected by the user. The result of this complex manipulation is not a very accurate simulation of what a particular athlete's performance would have been in a similar situation. Some of the random numbers or random event generator devices such as dice or spin wheels are not immune human influence or control.

This invention results from an attempt to provide a simple and inexpensive apparatus for accurately simulating the performance of well-documented athletes in the course of a virtual competition, and to stage virtual contests between sports figures and teams of the same or different eras.

SUMMARY OF THE INVENTION

The principal and secondary objects of this invention are to provide a simple, yet practical and entertaining table-top game device for staging virtual contests between combinations of known players and teams from various areas and eras in a particular sport, according to a process based on the statistical performances of former or contemporary athletes, that are not affected by any user control or intervention. The invention is particularly adapted to the statistically correct simulation of game based on individual players' skilled moves such as those required in the games of baseball, cricket, basketball or golf.

These and other valuable objects are achieved by the use of individual player cards bearing career statistics in the form of zones representing all the possible outcomes of a move. The zones are sized in proportion to the percentage of occurrence of each outcome during the player's career. A display of discrete locations individually selectable by a random number generator are juxtaposed or laid under the card zones, the randomly selected number combines with the size-proportional zone to provide an accurate rendition of the outcome of each selected move as if had been performed by the chosen athlete.

DESCRIPTION OF THE PREFERRED EMBODIMENT OF THE INVENTION

Figure 1:
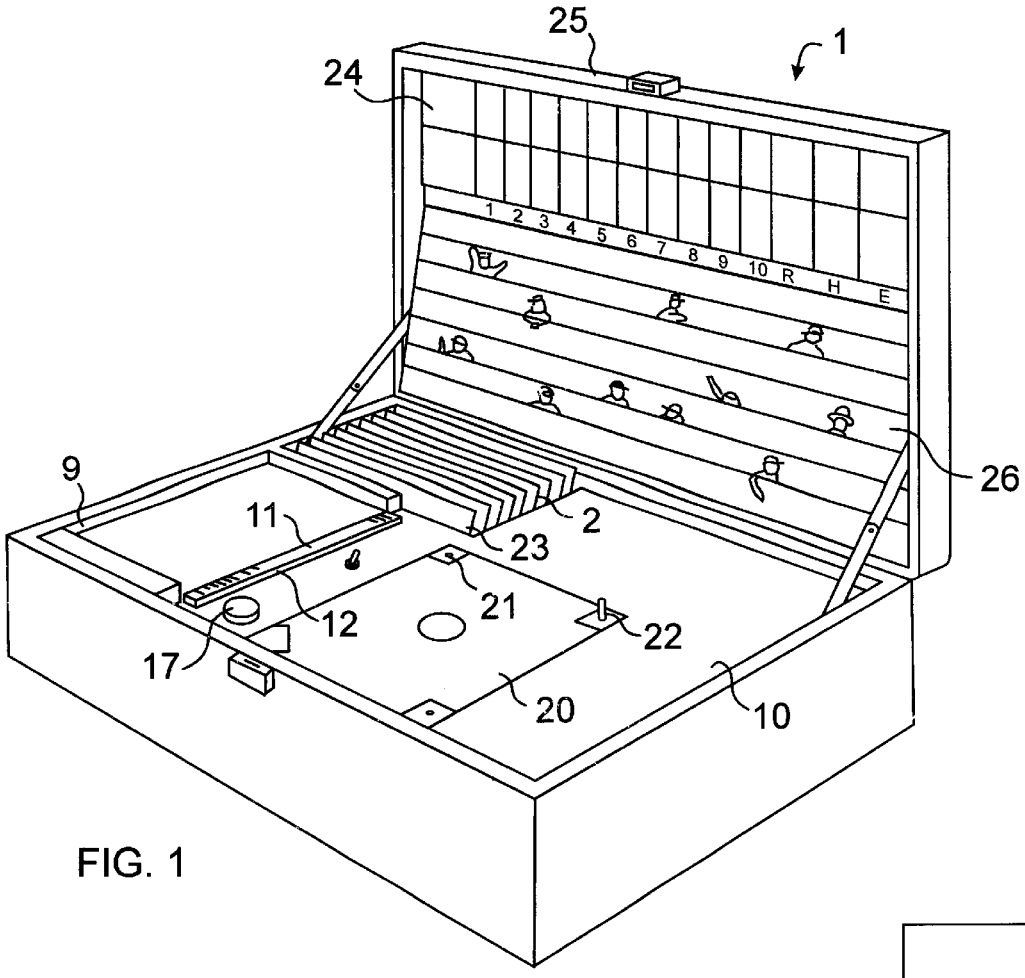
FIG. 1 is a perspective view of a table-top game apparatus according to the invention.
Figure 2:
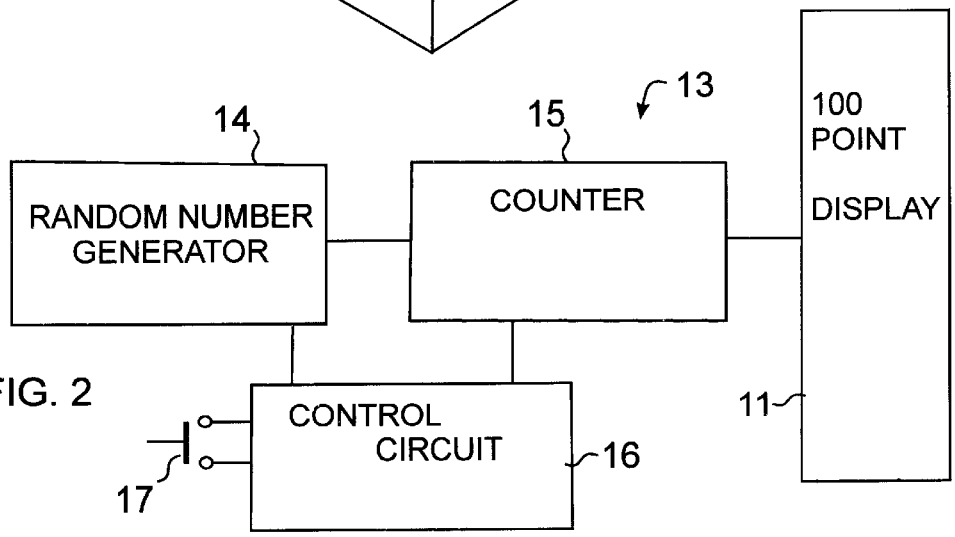
FIG. 2 is a block diagram of the random play outcome selector.

Referring now to the drawing, there is shown in FIG. 1, a table-top game apparatus 1 specifically configured for use by one or more users or participants in simulating virtual baseball games. The contestants of the games are assumed to be contemporary or former baseball players whose career statistics are well-documented.

It should be understood that the invention can be applied to similar embodiments of other types of sporting contests in which athletes compete against each other, either singly or as part of organized and coordinated teams.

Figure 3:
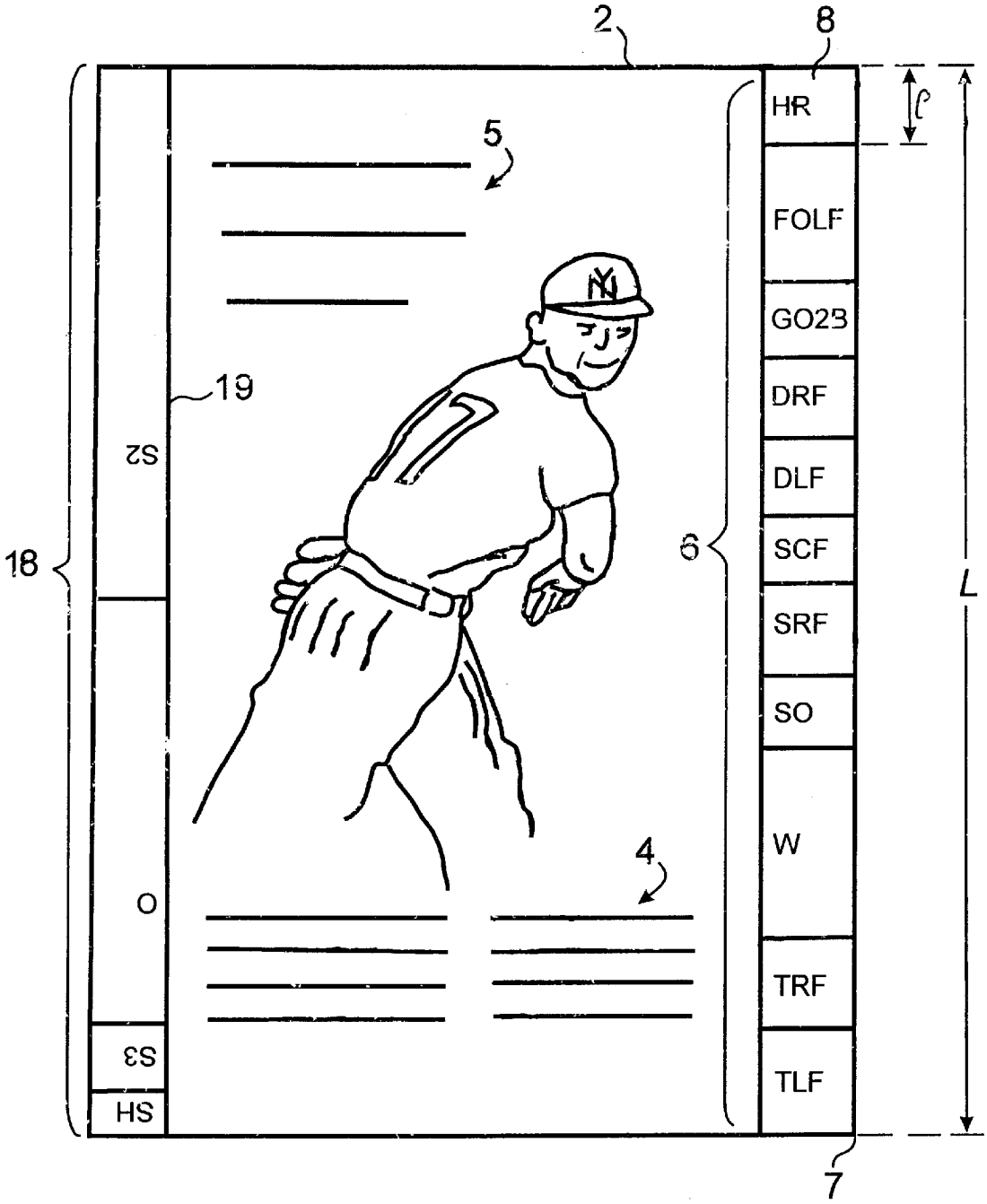
FIG. 3 is a top plan view of a player's card.

In the preferred embodiment, the players' careers are documented in a series of cards 2, an example of which is illustrated in FIG. 3. In addition to the optional likeness 3 and career highlights 4, the card carries the player's name and team affiliation 5. On one side of the card are a number of contiguous zones 6 distributed along a first line 7 constituted by the right edge of the card. The zones 6 form a bar consisting of contiguous segments of different lengths. The lengths 1 of a segment 8 in relation to the overall lengths L of the entire bar correspond to the percentage of occurrence of the outcome of a particular move during the player's career. In the illustrated example, each zone corresponds to the possible outcome of a batting move, to wit, a home run HR, a fly out to left field FOLF, a ground out to second base GO2B, a double to right field DRF, a double to left field DLF, a single to center field SCF, a single to right field SRF, a strike out SO, a walk W, a triple to right field TRF or a triple to left field TLF.

Each virtual move is played on the apparatus 1 by placing the player's card face up into a frame 9 at the lower right corner of the apparatus board 10. The right edge of the frame is constituted by an electronic display 11 consisting of a continuous array of 100 discrete locations 12 contiguously spread over a line having the same total lengths L than the right edge of the card 2 and the zone bar 6. Each discrete location consists of a LCD segment which can be individually illuminated in response to a random play outcome selector 130 The random play outcome selector comprises a random number generator 14 feeding a counter 15 whose accumulated count is fed to the 100 point display 11. A control circuit 16 activated by a play pushbutton 17 operates the random number generator according to electronic techniques well-known to persons with ordinary skill in that art. For example, the random number generator can be constituted by counting the time between two separate periodic signals of different frequencies. The counter can either be stopped in response to the activity of the play button 17 and made to hold its count until the next move; or may be selectively enabled to count between the next incidences of the two periodic signals. It should be appreciated that this type of random play outcome selector is not susceptible to human intervention as are the throw of dice, the spinning of a wheel and other random selection devices that have been taught by the prior art. Thus, upon activation of the play button 17, a single location 12 is lit on the display 11 and the virtual outcome of the play is read on the zone appearing next to the lit location. If the lit location appears to be aligned with a line of demarcation between two zones, the play button is, again, depressed until an unambiguous reading is obtained.

The card 2 may be rotated 180 degrees and repositioned into the frame 9 in order to determine the outcome of a base-running attempt. A second zone bar 18 is printed along the left edge of the card and each of the zones 19 correspond to the possible outcome of such an attempt. The lengths of each zone is proportional to the ratio of success over the number of base-stealing attempts performed by the player during his documented career, including stealing the second base 82, stealing the third base 83, stealing home base SH, or being thrown out O. A map 20 of a diamond baseball field is printed on the top surface of the game board 10 with holes 21 at each base, into which peags 22 of different shapes of colors can be used to indicate the position of the players during the virtual game. A convenient pocket 23 is provided to hold the player cards 2. An erasable scoreboard 24 is mounted against the inside cover 25 of the apparatus. The apparatus is further by a pictural representation 26 of bleachers filled with enthusiastic spectators The apparatus can be used to stage contests between combinations of players and teams from different eras of baseball history by accurately replicating the career statistics of current and former players. Contests between participants or users of the apparatus can also be simulated, each participant can play the role of a team manager who can select the players and the game strategy of his teams. It should be understood that the cards can carry statistical outcomes of other players' moves.

For instance, a special card may be used after the seventh inning to determine the defensive aspect of relief pitching. The card zone bar would have black-out areas corresponding to the pitcher's career earned run average. When the relief pitcher card is laid on top of the batter's card the black-out areas mask some of the safe hit batting zones in order to limit the probability of a batter's successful move.

While the preferred embodiment of the invention has been described, modifications can be made and other embodiments may be devised without departing from the spirit of the invention and the scope of the appended claims.

What is claimed is:

1. An apparatus, for simulating the performances of known sport figures based on their respective career statistics in the context of virtual games acted by at least one participant, said apparatus comprising:

a plurality of record-carrying media, each of said medium corresponding to one of said sport figures and including a plurality of zones, each representing one of the possible outcomes of virtual move by one of said participants, each of said zones being sized in proportion to the percentage of occurrence of said outcomes during said sport figure's career;

a random-selection device aimed at said zones;

whereby statistically realistic sporting contests may ha be simulated between individual ones or teams of said sport figures through sequential use of said media and random-selection device in accordance with rules of a particular sport.

2. The apparatus of claim 1, wherein said random-selection device probability of selecting one of said zones is proportional to the size of said zone.

3. An apparatus, for simulating the performances of known sport figures based on their respective career statistics in the context of virtual games acted by at least one participant, said apparatus comprising:

a plurality of record-carrying media, each of said medium corresponding to one of said sport figures and including a plurality of zones, each representing one of the possible outcomes of virtual move by one of said participants, each of said zones being sized in proportion to the percentage of occurrence of said outcomes during said sport figure's career;

a random-selection device aimed at said zones;

wherein said random-selection device probability of selecting one of said zones is proportional to the size of said zone;

said zones on said sport figure's medium are sequentially distributed along a first line of a given length, and the ratio of the linear dimension of each of said zone over said length is equal to said percentage; and said random-selection device comprises a display of an array of a plurality of a areas along a second line of said length;

whereby statistically realistic sporting contests may be simulated between individual ones or teams of said sport figures through sequential use of said media and random-selection device in accordance with rules of a particular sport.

4. The apparatus of claim 3, wherein said zones and said arrays are linearly contiguous.

5. The apparatus of claim 3, wherein said zones form a bar of contiguous segments having different lengths;

said array comprises a series of contiguous, individually selectable areas of equal lengths; and said apparatus further comprises means for placing said first line along said second line.

6. The apparatus of claim 5, wherein each of said media comprises a card having said bar along a first edge;

said random selection device further comprises a counter;

means for selectively illuminating one of said areas in response to a number of pulse accumulated in said counter; and means for sequentially accumulating random numbers of pulses into said counter.

7. The apparatus of claim 6 which further comprises a frame shaped and dimensioned to hold said card wherein said array is positioned along a side of said frame proximate the bar of said card.

8. The apparatus of claim 3, wherein said particular sport is baseball, and said possible outcomes consist of possible results of a batter's move.

9. The apparatus of claim 8 which further comprises a baseball diamond map, and means for indicating the position of a player on said map.

10. The apparatus of claim 3, wherein said particular sport consists of baseball, said possible outcomes comprises base stealing moves; and said percentage of occurrence consists of the ratio of success over the number of base-stealing attempts.

11. A table-top game, for use by at least one game participant, which comprises:

a plurality of known-players' cards, each card having a plurality of contiguous segments forming a bar of a given total length;

wherein each of said segments correspond to one of the possible outcomes of a move by a player, and the length of said segment is proportional to the percentage of occurrence of said outcome during said player's career;

a display including an array of a number of individually selectable, discrete locations, said array having said given length; and a random number generator having a maximum count equal to said number for selecting one of said locations;

whereby said random number generator may be activated to select one of said locations, and the bar of one of said player's cards can be matched with said array to determine the outcome of a move by a game participant.

12. The game of claim 11 which further comprises a frame shaped and dimensioned to hold one of said cards in a position wherein said bar and said array are juxtaposedly aligned.

13. The game of claim 12, wherein:

said random number generator further comprises a counter; and said display further comprises means, responsive to said counter, to selectively illuminate one of said locations.

14. The game of claim 12, wherein said particular sport consists of baseball, said possible outcomes comprises base running moves; and said percentage of occurrence consists of the ratio of success over the number of base-stealing attempts.

15. The game of claim 13 which further comprises means for displaying the position of a player on a field.

16. The game of claim 13, wherein said game is a game of baseball and said move comprises a batter's action.

* * * * *